United States Patent [19]

Mitzel

[11] 4,373,712

[45] Feb. 15, 1983

[54] APPARATUS FOR TRANSPORTING SHEET MATERIAL

[75] Inventor: Wilhelm Mitzel, Neukeferloh, Fed. Rep. of Germany

[73] Assignee: GAO Gesellschaft für Automation und Organisation mbH, Munich, Fed. Rep. of Germany

[21] Appl. No.: 82,314

[22] Filed: Oct. 5, 1979

[30] Foreign Application Priority Data

Jun. 7, 1979 [DE] Fed. Rep. of Germany ..... 2923148

[51] Int. Cl.[3] ..... B65H 5/02

[52] U.S. Cl. ..... 271/272; 271/275

[58] Field of Search ..... 271/272, 273, 274, 275, 271/198; 198/626; 226/172, 171

[56] References Cited

U.S. PATENT DOCUMENTS 3,193,283 7/1965 Smith ..... 271/275

3,271,025 9/1966 Rosenburgh et al. ..... 226/172

3,536,320 10/1970 Derby ..... 271/275

*Primary Examiner*—Joseph E. Valenza

*Assistant Examiner*—Brian Bond

*Attorney, Agent, or Firm*—Andrus, Sceales, Starke & Sawall

[57] ABSTRACT

An apparatus for transporting sheet material such as bank notes, comprising separate endless conveyor belt systems which are conducted about guide or deflection rollers of varying diameter and which extend parallel adjacent to the conveyance path. The individual sheets are held between the belts of the two systems by friction. In order to avoid different-size reversals when rollers with varying diameters rotate, the angle of contact of the conveyor belts is selected in response to the diameter of the rollers such that the reversal remains constant over the whole of the length. In the case of a finitely thick belt the word reversal means the velocity of the inner fibre running on the rollers in relation to the neutral fibre in %.

9 Claims, 11 Drawing Figures

APPARATUS FOR TRANSPORTING SHEET MATERIAL

BACKGROUND OF THE INVENTION

This invention relates to an apparatus for transporting sheet material such as bank notes, comprising two separate endless conveyor belt systems which are conducted about guide or deflection rollers of varying diameter and which extend parallel adjacent to the conveyance path, the individual sheet material being held between the belts of the two systems by friction and being transported along an arbitrary path from an infeed to a discharge point.

DESCRIPTION OF THE PRIOR ART

Such transport devices are employed, for instance, in the automatic processing of bank notes. The apparatus takes the individual bank notes separated from a stack in succession, conveys them past inspection stations and finally conveys them to appropriate destinations depending on the results of inspection. Such transport devices must meet high demands in accordance the their application. For instance, they must properly transport bank notes of different size, quality and condition without impairing the condition of the bank notes. This means a high constancy of speed, a minimum of skew, a minimum of fluttering and supression of static slip, i.e a statistically distributed reversal of the bank notes relative to the driving belt system due to system-inherent or external factors.

U.S. Pat. No. 2,076,493 already reveals a transport apparatus in which the sheet material, e.g. receipts, is held between two flat belts which run in a guide groove with laterally upright flanks. Since the belts cover a large part of the area of the conveyed sheet material, inspection thereof is greatly limited. Flat belt systems are also disadvantageous insofar as it is only possible to exchange the belts with considerable difficulty. Owing to the lateral flanks of the guide groove which serve to center the belt, it is impossible to exclude damage to the sheet material caused by it scraping along the flanks.

German publication print DE-AS No. 2,155,328 also recites a transport apparatus in which the sheet material is held between two flat belts, the deflection rollers, however, having a spherical design. This profile is supposed to impart stiffness and improved entraining force and to prevent the belts from rolling off the deflection rollers. The manufacture of spherical rollers, however, is expensive and the entraining force of the vaulted flat belts is inadequate in the case of limp or slack sheet material.

Finally, German laying-open print DE-OS No. 2,655,580 discloses a transport apparatus in which the bank notes are conveyed jammed between pairs of round belts. The belt pairs mesh slightly and impress into the bank notes a wavy or corrugated profile which, presuming the sheet material has a certain amount of stiffness, results in improved entraining forces. The use of round belts is advantageous in that only a small portion of the surface of the bank notes is covered and thus almost unimpeded inspection of both sides of the bank note is possible. Moreover, round belts can be replaced easily and without difficulty. A decisive disadvantage of this apparatus, however, is that the entraining forces are only inadequate in the case of limp transport material, i.e. worn bank notes, for example. This gives rise to obstruction when the material rubs against stationary parts, to enhanced static slip and to skewing.

The result is another problem, i.e. that due to the roller recesses which act respectively on one portion of the belts, the individual belts run along different radii of the deflection rollers and are thus driven at different speeds. It has been found that as they pass around the deflection roller and bank notes assume the speed of the inner fiber of the respective transport belts which press the bank notes against the rollers and are thus slowed down in the contact segment as compared to the straight segment. After leaving the contact segment, the bank notes again adapt to the speed of the free path of the transport belts. This, however, results in the bank notes continuously being compressed together and pulled apart. Sine both belt pairs are involved in transporting the bank note along the straight segments, the bank note assumes an undefined speed if the belts travel at different speeds. Together with the inadequate entraining forces, the different local speeds cause a more or less large, statistically distributed slip in the transport of the bank notes. This uncontrollable slip is disadvantageous, since a stacking device located at the end of the transport apparatus is synchronized with the original timing of the bank notes which has now varied due to the resultant slippage which in turn can result in a disruption and even complete blockage of the unstacking operation. Moreover, it it is just possible that the bank notes will run up on top of one another so that inspection or switching functions can no longer be performed.

To prevent the slack or slip, it has already been proposed to convey the conveyor belts between two endless conveyor belts along a zig-zag path between deflection rollers which lie appropriately close together. Owing to the contact segments, high entraining forces act on the transport material at the points of contact. This, however, is also considered to be disadvantageous, since a relatively large number of guide rollers must be provided to form the zig-zag path. Major portions of the transport path are concealed on both sides which is a drawback in light of the positioning of inspection or examination means.

The result of all of the above is that a transport apparatus for thin sheet material, e.g. bank notes for instance, should fulfill substantially two conditions. On the one hand, the transport material must be freely accessible in large part so that large-scale inspection of the bank notes is possible. This condition gives rise to the use of narrow conveyor belts which are easy to guide and manipulate. On the other hand, the bank notes must be conveyed with the highest possible entraining forces which makes the use of contact segments self-evident. The consistent application of these conditions, however, is counterbalanced by the following difficulties.

A belt travelling around a guide roller is decelerated during this contact as far as its inner fiber is concerned, i.e. the fiber abutting on the roller, compared to the normal belt fiber positioned in the axis of the bore. Hence, the transport material is also slowed down relative to the normal belt speed and is reversed compared to the driving belt. This theoretical delay is dependent on the ratio of the radii of the belt and guide roller and can be calculated. If several rollers of varying diameter follow one another, which is necessary due to the larger separating roller which determines the timing and the smaller transport rollers which permit large spaces for inspection or examination, a bank note passing through the contact areas of these rollers experiences different delays. The bank note is compressed or stretched which can result in folding or tearing. If the distances between the deflection rollers are enlarged, the bank note will initially pass through a free path segment after every contact, thereby eliminating the advantages gained by means of the contact segments, since the bank note in the free stretch will assume some speed between the different belt speeds, thus causing uncontrollable slip.

Furthermore, the use of guide rollers of equal diameter, i.e. with the same theoretical deceleration of the inner belt fibers compared to the normal belt fibers, is not a solution of this problem either, since, as already stated, the actual deceleration at the guide rollers does not correspond to the theoretical values.

SUMMARY OF THE INVENTION

The object of the invention is to provide a transport apparatus of the type mentioned at the outset in which the sheet material is conveyed with high entraining forces and the so-called statistical slip is eliminated, i.e. retaining the original timing up to the end of the transport path.

This object is accomplished in accordance with the invention in that the angle of contact of the conveyor belts on all deflection rollers of the conveyor path is selected in response to or as a function of the diameters thereof such that the sheet material is transported at the same speed on all deflection rollers.

Contrary to the theoretical consideration, it has been found that the deceleration of the inner belt fibers, i.e. the fibers running directly on the roller surface which determines the speed of the sheet material, relative to the normal belt fibers is also dependent on the angle of contact of the corresponding deflection roller. Hence, selecting the angle of contact makes it possible to correct the deceleration theoretically expected at a deflection roller with a specific diameter in such a way that the deceleration has the same value for all deflection rollers.

As far as the dependency of the reversal on the respective angle of contact is concerned, it has been found that the actual reversal or deceleration of the transport material relative to the neutral fibers of the transport belt for a given roller diameter gradually increases from zero, i.e. no deceleration relative to the neutral fibers of the transport belt, with an angle of contact of $\alpha=0$ to a saturation value as the angle of contact increases. The saturation value is approximately inversely proportional to the diameter of the deflection roller. In order to determine the angle of contact at the individual rollers, it is advantageous to proceed such that, first of all, the saturation value of the deceleration or of that angle of contact (angle of saturation), above which the deceleration is constant, is determined for the roller with the largest diameter. The angle of contact of the roller of smaller diameter is thereafter selected such that the result is a deceleration value corresponding to the previously ascertained saturation value. The cited method is advantageous, insofar as the contact of the deflection roller of largest diameter can be selected arbitrarily above the angle of saturation without thereby changing the deceleration of this roller. The path of travel within the transport apparatus can be designed to be highly variable by virtue of this measure.

In a further development of the invention, the conveyor belts are round resilient belts. The deflection rollers have grooves associated with the belts which completely accommodate the belts respectively running between the sheet material and the roller. The belts running in these grooves do not have any effect on the speed of the sheet material. They serve merely to support the sheet material between the individual deflection rollers. The sheet material can also be supported by a flat baffle positioned between the individual deflection rollers. This baffle, e.g. of glass, makes the entire width of the bank notes accessible to optical inspection. The externally running belts, i.e. those belts which press the sheet material against the roller, are the only ones which determine the speed of the sheet material.

The spacing of adjacent deflection rollers is advantageously dimensioned such that the sheet material is constantly located in at least one contact segment. This effects restraint with high entraining forces at the points of contact.

Between the pinch sites the entraining force acting on the sheet material is less by a multiple so that different belt speeds are unimportant for the transport of the sheet material.

In a further embodiment of the invention, all deflection rollers are encircled in the same direction. Since owing to this measure all deflection rollers are positioned on the same side of the belt system, it achieves the advantage that sufficient room is available to mount inspection and examination equipment.

BRIEF DESCRIPTION OF THE DRAWING

The invention and one embodiment will be described in more detail in the following with reference to the enclosed drawing, in which.

DESCRIPTION OF THE PREFERRED EMBODIMENT

Figure 1:
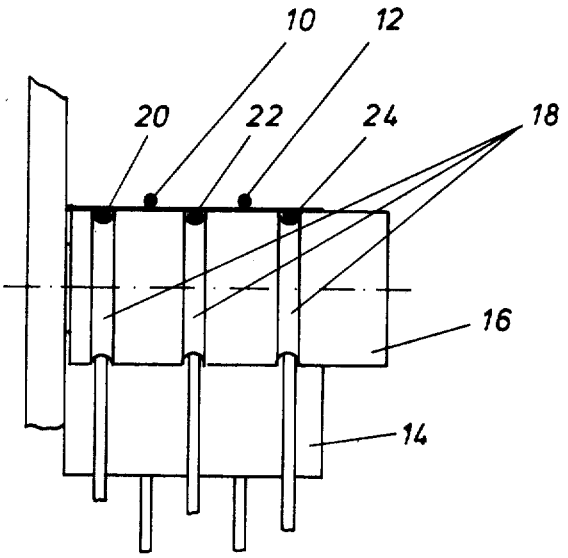
FIG. 1 is a top elevation of a deflection roller with a bank note passing through the deflection roller in the contact segment.
Figure 2:
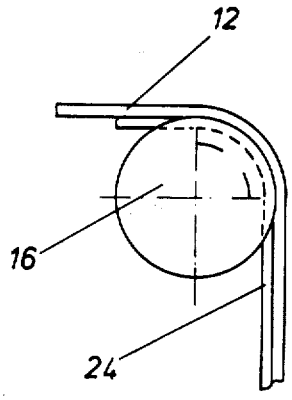
FIG. 2 is a front elevation of the deflection roller.
Figure 3:
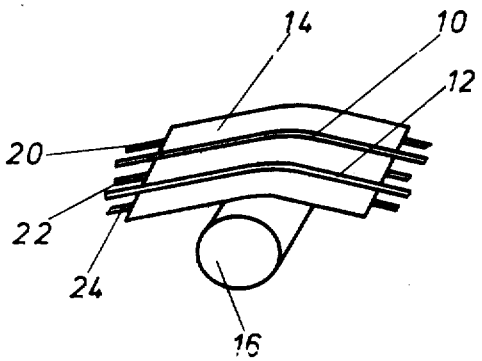
FIG. 3 is a perspective of the deflection roller.

A diagrammatic view of a contact segment is shown in FIGS. 1 to 3. Two externally running conveyor belts 10,12 press a bank note 14 against the surface of a deflection roller 16. Grooves 18 are recessed into the surface of the roller 16 which completely accommodate the internally running belts 20,22,24. Due to the contact pressing of the externally running belts 10,12, the friction between the bank note 14 and the roller 16 as well as between the bank note 14 and the belt increases. The contacting belt 10, 12 determines the speed of the bank note, whereas the accommodated belt 20, 22, 24 only acts to support the bank notes. The entraining forces which act on the bank note in this pinch are dependent on the angle of contact, the belt tension, the number of belts, the roller diameter, the coefficient of friction between the belt and the bank note as well as the coefficient of friction between the bank note and the roller. In the case of the double contact shown in FIG. 3 the entraining force amounts to between 80 and 100 p, for instance, depending on the quality of the bank note. These values were measured with an angle of contact $\alpha=2.5°$, a belt tension of 700 p, a belt diameter of 3 mm, a roller diameter of 40 mm and a groove depth of 3 mm also. By contrast, the entraining force of a so-called corrugated cardboard guide, i.e. a guide in which the bank note is held in longitudinal profiles due to the meshing belts, amounts to only a few p.

Figure 4A:
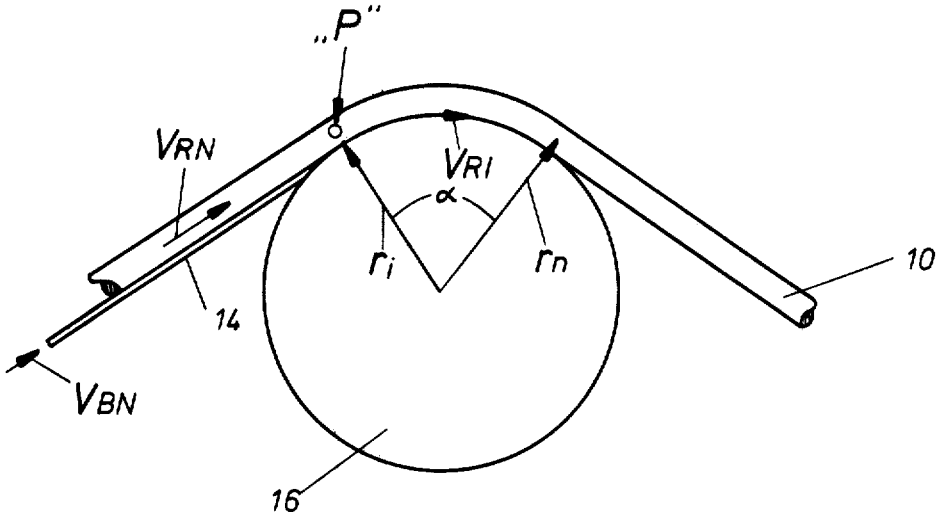
FIGS. 4*a*, 4*b* show the contact of a roller with a belt to illustrate the reversal.
Figure 4B:
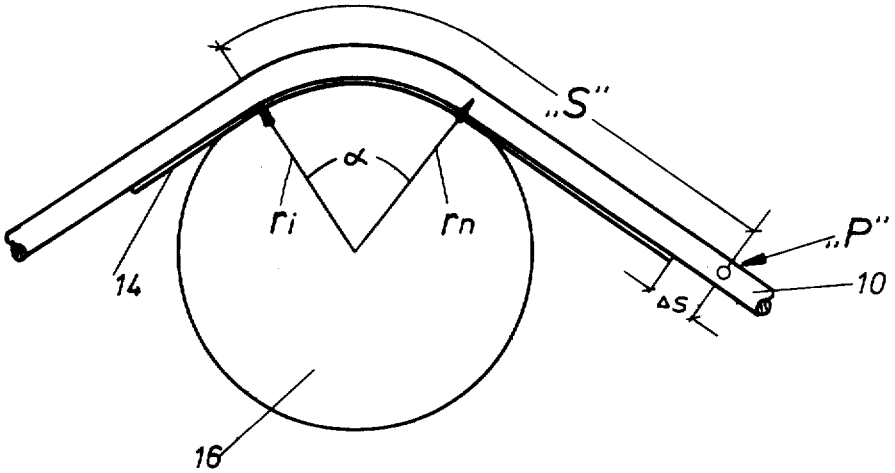

The speed behavior of the bank note in a contact segment will be explained in detail hereinafter with reference to FIGS. 4*a*, 4*b*. These figures only show the transport belt which lies on the surface of the roller and which determines the speed of the bank note.

A belt 10 encircling a roller 16 with the normal belt speed of $V_{RN}$ drives this roller theoretically at the speed of the inner fibers $V_{RI}$. This speed is also assumed by a bank note 14 ($V_{BN}$) positioned between the belt 10 and the surface of the roller 16.

Hence the theoretical equation:

$$V_{RI}=(R_i/r_n)\cdot V_{RN}=V_{BN}.$$

$V_{RI}$ is thus always smaller than $V_{RN}$, in particular in the ratio of the radii of the inner fibers/neutral fibers. For a belt with a diameter of 3 mm which encircles a roller 40 mm in diameter, this means a difference in speed of 7%. For a roller 80 mm in diameter, the difference in speed amounts to 3.6%. The following equation is applicable outside of the contact segment:

$$V_{RI}=V_{RN}.$$

Owing to the decelerated transport speed of the bank note relative to the neutral fibers, the contact segment pushes the bank note back or reverses its passage by the distance $\Delta s$. To demonstrate the reversal of the bank note by the distance $\Delta s$, FIG. 4*a* shows a bank note located immediately in front of the nip, whereas FIG. 4*b* depicts a situation in which the bank note has passed through the contact area in part. $\Delta s$ is the difference in distance between the leading edge of the bank note passing through the contact area and a mark "P" on the transport belt which coincided with the leading edge of the bank note prior to entrance of the bank note. If the difference in distance is based on a predetermined distance of passage "S", the following equation expresses the percentage of reversal:

$$Z[\%]=(\Delta s/S)\cdot 100=[1-(r_i/r_n)]\cdot 100$$

Figure 5:
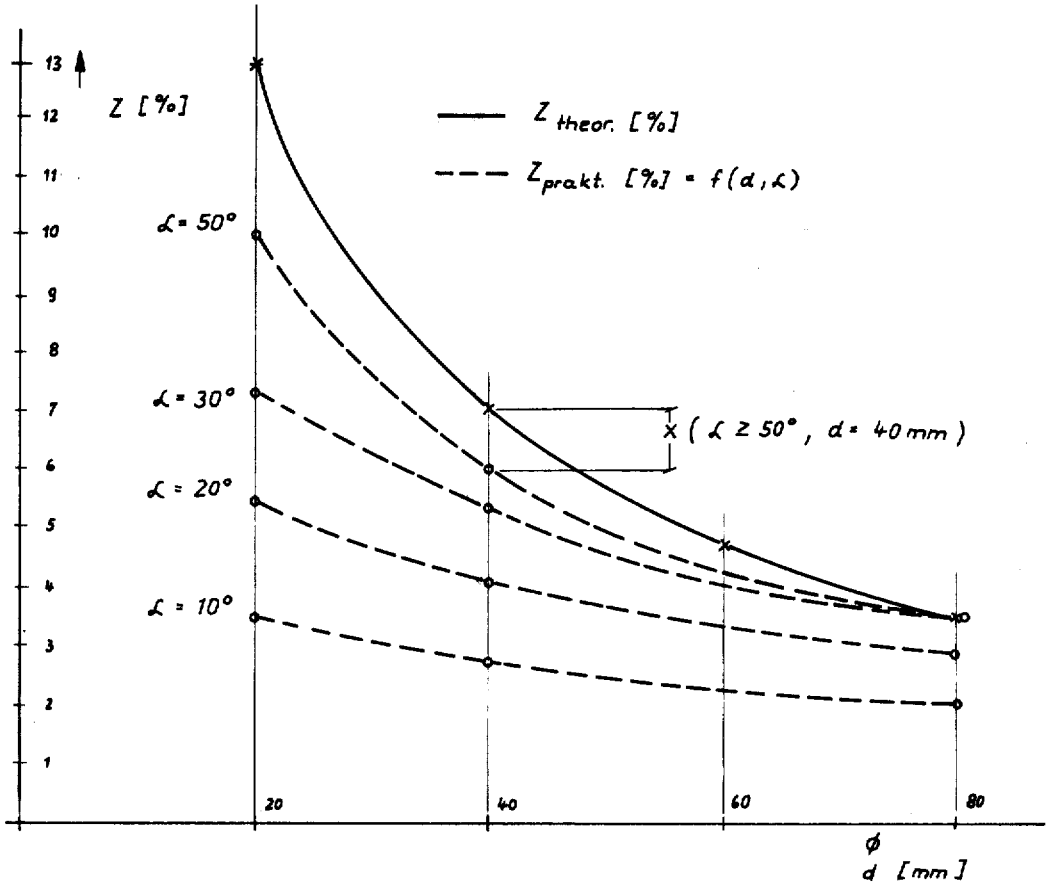
FIG. 5 shows the relation between reversal Z[%] and the diameter of the roller d[mm] in theory and in practice.

This relation is illustrated graphically in FIG. 5. The abscissa is the diameter of the roller in millimeters, the ordinate represents the reversal "Z" expressed in percent. The belt diameter is assumed to be 3 mm. As can be seen, the reversal "Z" is theoretically dependent solely on the ratio of the radii of the roller/belt and thus on the roller diameter in this case.

Practice, however, shows that the actual reversal is also dependent on the angle of contact of the belt about the roller. The actual dependency of the reversal "Z", determined by experiment, is also entered for various angles of contact $\alpha$ as a function of the roller diameter in FIG. 5. As can be seen, the practical value gradually approaches the theoretical value as a function of the roller diameter above an angle of contact amounting to approx. 50°. If the angles of contact and the roller diameters are small, the practical value deviates considerably from the theoretical value. This behavior can be taken into account mathematically by a correction factor which is dependent on the roller diameter and the angle of contact. The result is the new equation as follows:

$$Z[\%]=[1-(r_i/r_n)]\cdot 100\cdot X(\alpha,d)$$

Figure 7:
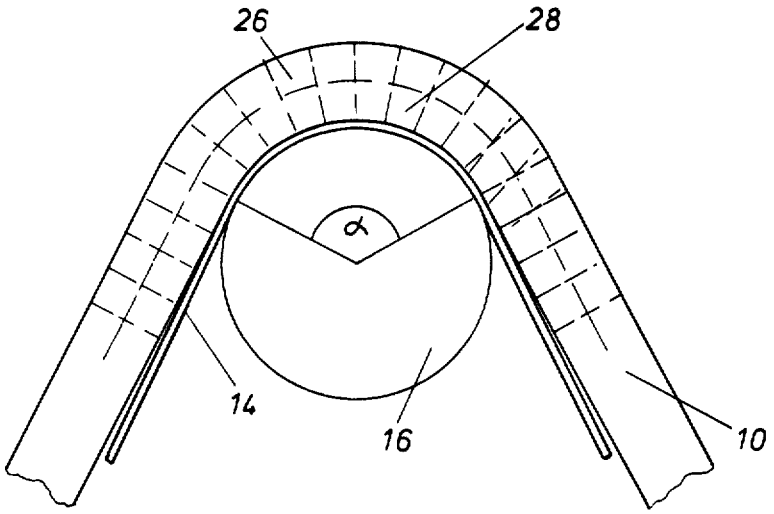
FIG. 7 shows the contact of a roller with a belt with illustrated zones of compression and elongation.

The deviating behavior of the practical value from the theoretical value can probably be explained by the inhomogeneous zones of compression in the transition of a straight leg of the belt into a curvilinear leg of the belt. As FIG. 7 reveals, the belt in the outer area 26 is stretched and in the inner area 28 is compressed. These zones of changed tension do not proceed suddenly, but rather gradually into homogeneous tension which is predetermined by the respective belt curvature. Since the bank note is relatively non-resilient with respect to the encircling belt, it assumes an intermediate speed. As it enters the contact zone, the bank note is compressed, i.e. there is a tendency up to the middle of the contact segment to crumple the bank note. As it leaves the contact zone, a forward pull uncrumples it. Only part of the tension is resiliently absorbed by the bank note. For this reason, the theoretical deceleration value is never completely attained.

Figure 6:
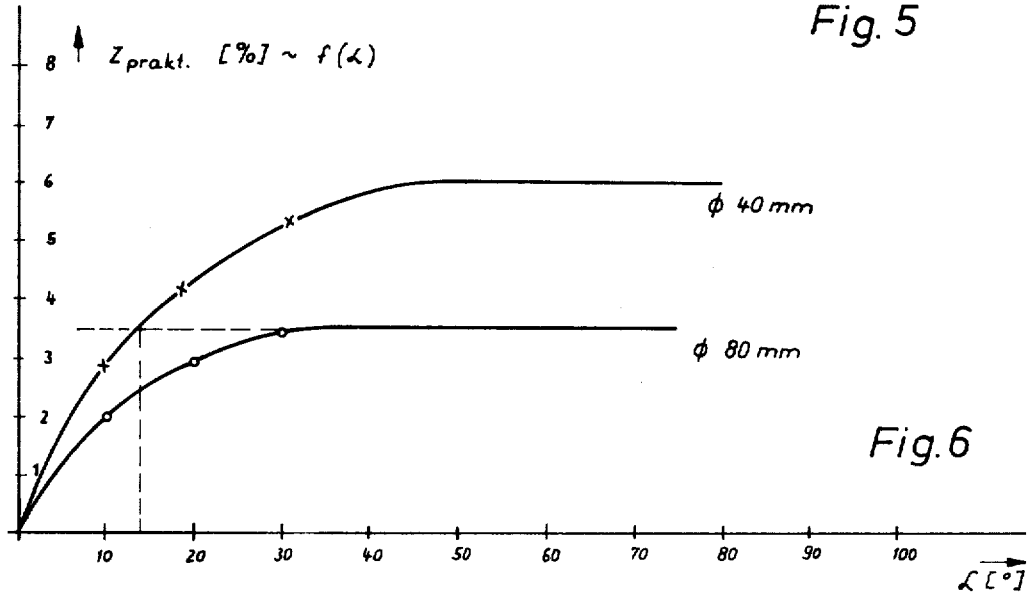
FIG. 6 shows the relation between reversal Z[%] and the angle of contact $\alpha$[°] for rolls with d=40 and d=80 mm diameter.

For the concept of transport paths within the meaning of the invention, it is more expedient to plot the reversal "Z" directly as a function of the angle of contact "$\alpha$", in particular with the roller diameters relevant for the transport path as the parameters. This relation is shown in FIG. 6, the roller diameters being chosen to amount to d=80 mm and d=40 mm. The curves can be derived from FIG. 5. They can of course also be determined directly by experimentation as well be explained hereinbelow. The angles of contact of the individual deflection or guide rollers 16 are now selected such that first of all the reversal to be generally adjusted for the largest deflection roll used is chosen, a roller 80 mm in diameter in the example shown. As the figure reveals, the reversal (80 mm roller) gradually increases from zero with an angle of $\alpha=0$ to a saturation value which is attained approximately with an angle of $\alpha\geqq 30°$. The limit reversal amounts to approx. 3.5%. In order to attain the same deceleration with a roller of smaller diameter, e.g. a roller of d=40 mm diameter, the ordinate value of the associated curve of 3.5% merely has to be followed down, resulting in an angle of contact of $\alpha=14°$. The diagrammatic solution is shown in FIG. 6.

Accordingly, deflection rollers 80 mm in diameter can be employed in the transport apparatus whose angles of contact can have any arbitrary magnitude starting from 30° upwards. The deflection or guide rollers 40 mm in diameter which are integrated into the system, however, must have an angle of contact amounting to 14° for each. The result is uniform and valid in all cases, i.e. a reversal "Z" of 3.5% relative to the neutral fibers of the externally running belts. The bank note is conveyed through the entire system at a constant speed. Neither compression nor extension occurs and the unstacking device at the end of the transport path can be adjusted accurately to the sequence in which the bank notes are separated.

Figure 8:
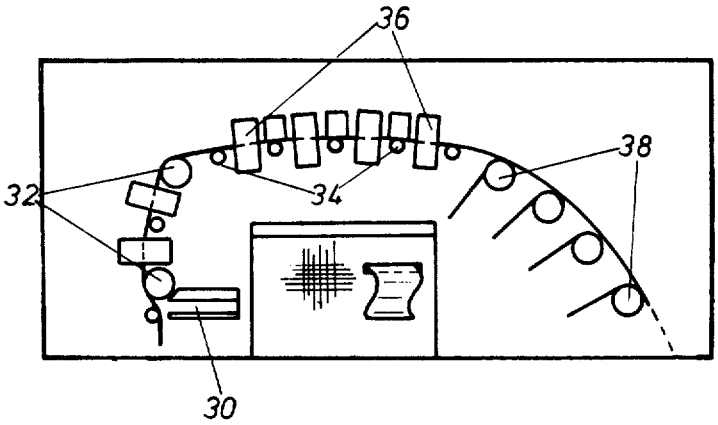
FIG. 8 is a schematic sketch of a transport path with contact segments in accordance with the invention.

FIG. 8 illustrates the path of travel of a transport apparatus in a machine for sorting bank notes. Starting from an infeed means 30, the individual separated bank notes run through a series of drive and deflection rollers 32,34 past the inspection stations 36 to the stacking units 38. The rollers 32 have a diameter of 80 mm and permit arbitrarily large changes in direction above the saturation contact. The contact at the smaller rollers 34, as mentioned above, is dependent on the saturation contact of the large rollers and is maintained according to this definition. Under these marginal conditions, a completely innovative arcuate path of travel evolves. The bank note is driven at a constant speed along the entire path.

Figure 9:
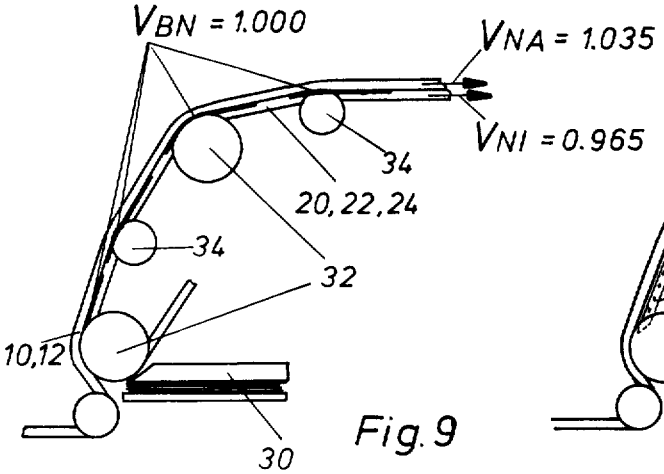
FIG. 9 is a section of the assembly shown in FIG. 8.

As FIG. 9 illustrates, in such a path of travel in which one belt system constantly runs externally and another constantly runs internally, the external belt will be driven at a 3.5% greater speed irrespective of the 3.5% reversal which is calculated and is equal for both roller diameters, while the internal belt will be driven at a 3.5% slower speed. Based on a theoretical speed of the bank note amounting to 1000, the result for the externally running belts 10,12 will be a speed of 1.035 and for the internally running belts 20,22,24 a speed of 0.965. On the basis of these measures, the bank notes will be conveyed in all contact areas at a constant speed of 1.000.

Figure 10:
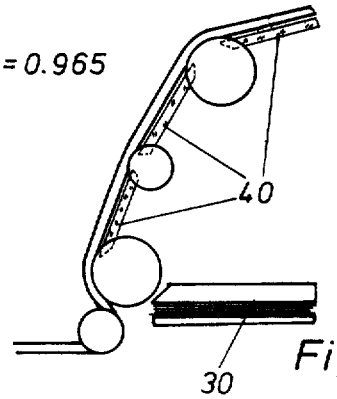
FIG. 10 is the assembly shown in FIG. 9, the internally running belts having been replaced by baffles.

As already mentioned, the internally running belts 20,22,24 serve merely to support the transport material. They can therefore be replaced, as shown in FIG. 10, by a flat guide plate 40 which is positioned between the individual deflection rollers and which, consisting of glass, for example, render the entire width of the bank note accessible to optical inspection and examination.

The percent reversal can be determined experimentally by employing transport rollers of varying diameter in a test set-up. The arrangement of the belts about the deflection rollers can be adjustable with respect to the feed leg or return leg or both legs of the belts so that angles of contact amounting from $\alpha=0$ to $\alpha=90°$ can be chosen. A sheet is inserted into the feed leg and a mark corresponding to the leading edge of the sheet is made on the belt which runs about the roller externally (see also FIGS. 4*a*, 4*b*). After the sheet has passed through the contact area covering distance "S", the reversal $\Delta s$ is measured, i.e. the distance between the mark on the transport belt and the leading edge of the sheet. The percentage reversal of the internal fibers or of the sheet during passage through the contact area relative to the neutral fibers of the upper driving belt can then be calculated according to the afore-mentioned equation:

$$Z[\%]=(\Delta s/S)\cdot 100$$

The speed of sheet passage does not play an important part. For this reason, the assembly can also be driven by a hand crank, for example.

The angle of contact $\alpha$ is now varied until the desired reversal results for the deflection roller of predetermined diameter. This angle of contact must subsequently be taken into account when the deflection roller is installed in the transport apparatus.

The consequence of applying the inventive teaching is that the path of travel of the transport system does not have to be planned, as was hitherto the case, such that the transport system conducts the sheet material past specific, fixed functional units, but rather the transport system now enjoys clear priority, i.e. the functional units required to process the sheet material can now be designed and positioned irrespective of the necessities which evolve in so doing. This reversal of past practice is the prerequisite for transporting the sheet material at a constant speed.

What is claimed is:

1. Apparatus for transporting sheets of material in a path from an input to a discharge, the path being bent resulting in a set back of the sheets as they traverse bends in the path, said apparatus comprising:

a plurality of direction changing rollers lying along the path and defining bends therein said rollers being of differing diameters; and a sheet transporting belt means extending across said rollers for transporting the sheets along the path, the arcuate contact angle ($\alpha$) between said belt means and roller at each of said rollers being selected in accordance with the diameter (d) of the roller such that the sheets at each of said rollers are subjected to the same amount of set back, said rollers being so positioned along said path that the sheets are continuously contacted by at least one roller.

2. The apparatus according to claim 1 wherein the arcuate contact angle ($\alpha$) for each roller is so chosen that the set back of the sheets defined as a percent of a predetermined transport distance is expressed by the equation $$Z[\%]=[1-(r_i/r_n)]\cdot 100\cdot X(\alpha,d)$$

whereby $r_i$ = the radial distance to the sheet transporting belt means surface abutting the sheets $r_n$ = the radial distance to the neutral axis of the sheet transporting belt means and X = an experimentally determined quantity representing the deviation between the actual set back of the sheets and the theoretical set back as a function of arcuate contact angle ($\alpha$) and roller diameter (d).

3. The apparatus according to claim 1 or 2 wherein the arcuate contact angle on smaller rollers is so established as to provide the same amount of set back to the sheets as occurs on the roller of the largest diameter.

4. The apparatus according to claim 1 or 2 wherein said sheet transporting belt means has a pair of parallel belt means for transporting the sheets therebetween.

5. The apparatus according to claim 4 characterized in that said belt means include a plurality of round belts, and wherein said rollers have grooves for embracing the belts of one of said belt means.

6. The apparatus according to claim 1 wherein said rollers are so positioned that the bends in the path all curve in the same sense.

7. The apparatus according to claim 4 wherein the sheet material has a desired transport speed through said apparatus, wherein one of said belt means comprises an outer belt means and the other of said belt means comprises an inner belt means, and wherein the speed of the outer belt means is increased by the factor related to the amount of set back and the speed of the inner belt means is decreased by a factor related to the amount of set back.

8. The apparatus according to claim 1 further including guide plates intermediate said rollers and operatively associated with said sheet transporting belt means for guiding the sheets along the path.

9. The transport apparatus according to claim 7 wherein said guide plates are of optically transparent material.

* * * * *